United States Patent [19]

Hruby et al.

[11] Patent Number: 5,068,642

[45] Date of Patent: Nov. 26, 1991

[54] ALARM OR WARNING DEVICE WITH SENSING MEANS IN THE FORM OF A D.C. BIASED SHIELDED COAXIAL CABLE

[75] Inventors: Vincenzo Hruby, Milan; Raffaele Vizzotto, Casalserugo, both of Italy

[73] Assignee: Hesa S.p.A., Milano, Italy

[21] Appl. No.: 501,125

[22] Filed: Mar. 29, 1990

[30] Foreign Application Priority Data

Apr. 7, 1989 [IT] Italy ..... 20058 A/89

[51] Int. Cl.[5] ..... G08B 13/26

[52] U.S. Cl. ..... 340/562; 340/566; 340/573

[58] Field of Search ..... 340/566, 562, 552, 573; 128/782

[56] References Cited

U.S. PATENT DOCUMENTS

| | | | |
|---|---|---|---|
| 3,728,700 | 4/1973 | Duval | 340/573 X |
| 3,760,794 | 9/1973 | Basham | 340/573 X |
| 3,875,433 | 4/1975 | Uchikawa | 340/562 X |
| 3,947,835 | 3/1976 | Laymon | 340/566 |
| 4,197,529 | 4/1980 | Ramstedt et al. | 340/566 |

FOREIGN PATENT DOCUMENTS 0272785 6/1988 European Pat. Off. .

*Primary Examiner*—Glen R. Swann, III
*Assistant Examiner*—Thomas J. Mullen, Jr.
*Attorney, Agent, or Firm*—Young & Thompson

[57] ABSTRACT

Alarm or warning device using, as sensing means, a low voltage D.C. biased shielded coaxial cable. The cable is positioned along the periphery of the area under control, and one or both of its ends are connected to an electronic circuit adapted to detect the voltage variations at the cable ends, deriving from its capacity variations resulting from the subsonic shock waves caused by the movement of things or people in the neighborhood of the cable. The device of the invention is used in alarm systems against intrusions and thefts, both for real and personal property. In the first case, it is preferably positioned underground and it may also comprise screening means allowing to detect the movements coming from different directions. The device is also advantageously used in the medical field, for the remote control and warning of the life functions of a patient.

13 Claims, 4 Drawing Sheets

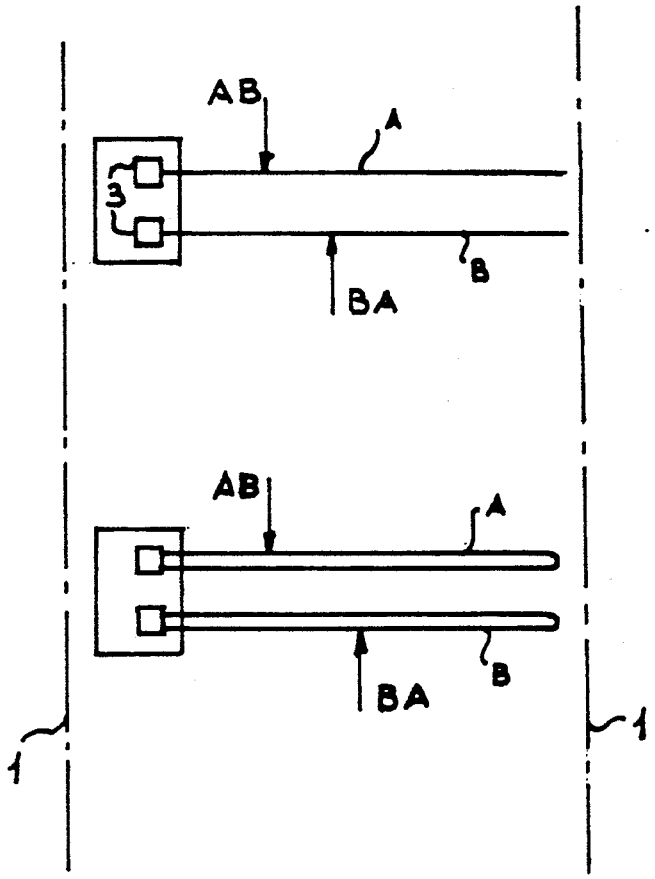
Fig. 3
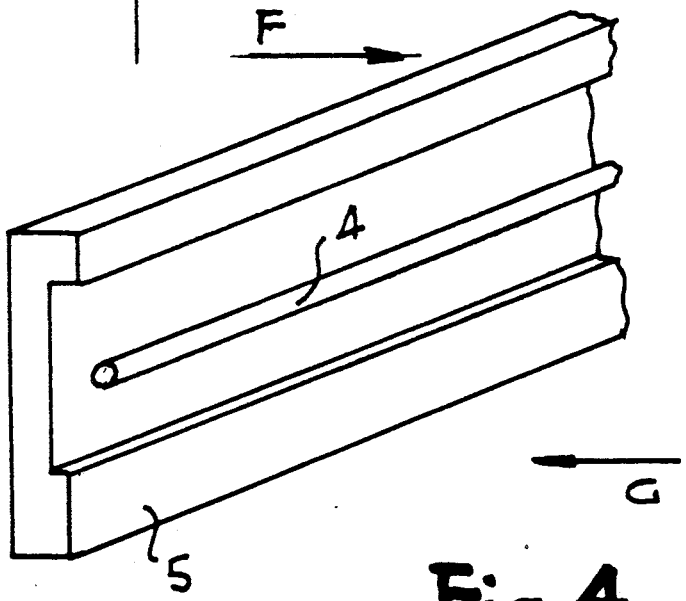
Fig. 4
Fig. 5
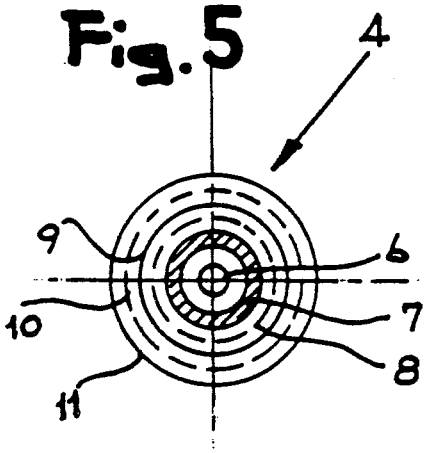

ALARM OR WARNING DEVICE WITH SENSING MEANS IN THE FORM OF A D.C. BIASED SHIELDED COAXIAL CABLE

BACKGROUND OF THE INVENTION

1. Field of the Invention

The present invention concerns an alarm or warning device using, as sensing means, a low voltage D.C. biased shielded coaxial cable. This cable is connected to an electronic circuit which processes the voltage variations at the cable ends and energizes alarm or warning means as predetermined conditions take place.

The alarm or warning device of the present invention is used with particular advantages for the control of large areas and, generally, in alarm systems against intrusions and thefts in real and personal property, as well as in the medical field for the remote control and warning of the life functions of a patient. It has interesting and innovating characteristics both for what concerns its installation, which is practical and economic, and for what concerns its working, which is reliable due to the impossibility of eluding or impairing the device, and finally for what concerns its useful life.

2. Description of the Prior Art

Alarm devices using, as sensing means, electric circuits working as capacitors, have been known for a long time. Such devices detect the variations in the electric characteristics of said circuits (voltage or current) when a load weighs thereon, which serves to modify—though imperceptibly—their physical structure and, consequently, their electrical capacitance.

Such known sensing means normally consist of composite structure carpets, the conductive elements of which are connected to an electronic monitoring circuit. Carpets thus formed can simply be laid on the ground, or underground, and are adapted—as seen heretofore—to detect the loads weighing thereon.

Though, on one hand, such known sensing means have represented a positive improvement over the ones used in previous alarm systems—as they can be totally hidden and are unlikely to undergo false alarms—on the other hand they involve different drawbacks which have, up to date, limited their field of application. In fact, in the first place, such carpets involve high production costs, which make their use uneconomical when having to control fairly large areas. Moreover, the underground installation of carpet sensing means is particularly delicate and costly and, furthermore, such carpets can evidence in the long run problems of moisture tightness along their edges, which can irreparably compromise their functionality, forcing the use into costly replacements.

The most serious drawback derives however from the fact that the aforedescribed carpets have to be positioned in strategic points, where it is presumed that the intrusion having to be prevented is more likely to occur; whereby, they become quite useless, or else involve prohibitive costs, when these strategic points are too many (buildings with a lot of possible entries) or do not even exist (for instance, the fence of a factory, each point of which can be a possible point of intrusion).

Finally, for what concerns personal property, such carpet sensing means are fit only for movables of small size.

SUMMARY OF THE INVENTION

The object of the present invention is therefore to provide a new alarm device, apt to overcome the above drawbacks and allowing to dispose of economic sensing means, which are positively reliable against any possible attempt of elusion or impair, which are perfectly sealed against atmospheric agents and particularly moisture, and which have a long lasting life.

Another object is to provide an alarm device having characteristics such as to require installation works of reduced cost, in case of a permanent alarm device for controlling real property, and of practically no cost, in case of a temporary alarm device for controlling movables.

A further object of the present invention is to supply a new warning device, to be used in the medical field for the remote control of the life functions of a patient, which does not require physical contact between the device, or parts thereof, and the patient himself.

According to the present invention, said objects are reached with an alarm or warning device of the type comprising sensing means in the form of an electrically charged capacitor, and an electronic circuit apt to detect the variations in the electric characteristics of said capacitor and to accordingly energize alarm and warning means, characterized in that, said sensing means consist of at least one shielded coaxial cable, one or both ends of which are connected to said electronic circuit, and in that, a D.C. constant biasing potential difference is kept between the shielding and the inner conductor of said cable.

According to an embodiment of the invention—particularly suited for permanent alarm devices controlling real property—the coaxial cable is positioned under the soil surface and parallel thereto, and a substantially vertical continuous baffle slab of a material having a density greater than the surrounding ground is positioned on the side external to that controlled by the alarm device.

According to another embodiment of the invention—particularly suited for temporary alarm devices controlling movables—the coaxial cable is positioned on the soil surface, or onto any suitable support, in proximity of or in contact with the objects to be controlled.

According to a further embodiment—particularly suited for use in the medical field, for controlling the life functions of a patient—the coaxial cable is fixed to the patient's bed structure.

BRIEF DESCRIPTION OF THE DRAWINGS

The invention is now described in further detail, with reference to the accompanying drawings, in which:

FIG. 3 is a diagrammatic plan view of a further type of installation of a device of the present invention similar to that of FIG. 1;

FIG. 4 is a diagrammatic perspective view showing directional sensing means to be used in the devices shown in FIGS. 1 to 3;

FIG. 5 is a cross section view of the coaxial cable used as sensing means in the device of the present invention;

DESCRIPTION OF THE PREFERRED EMBODIMENTS

Figure 1:
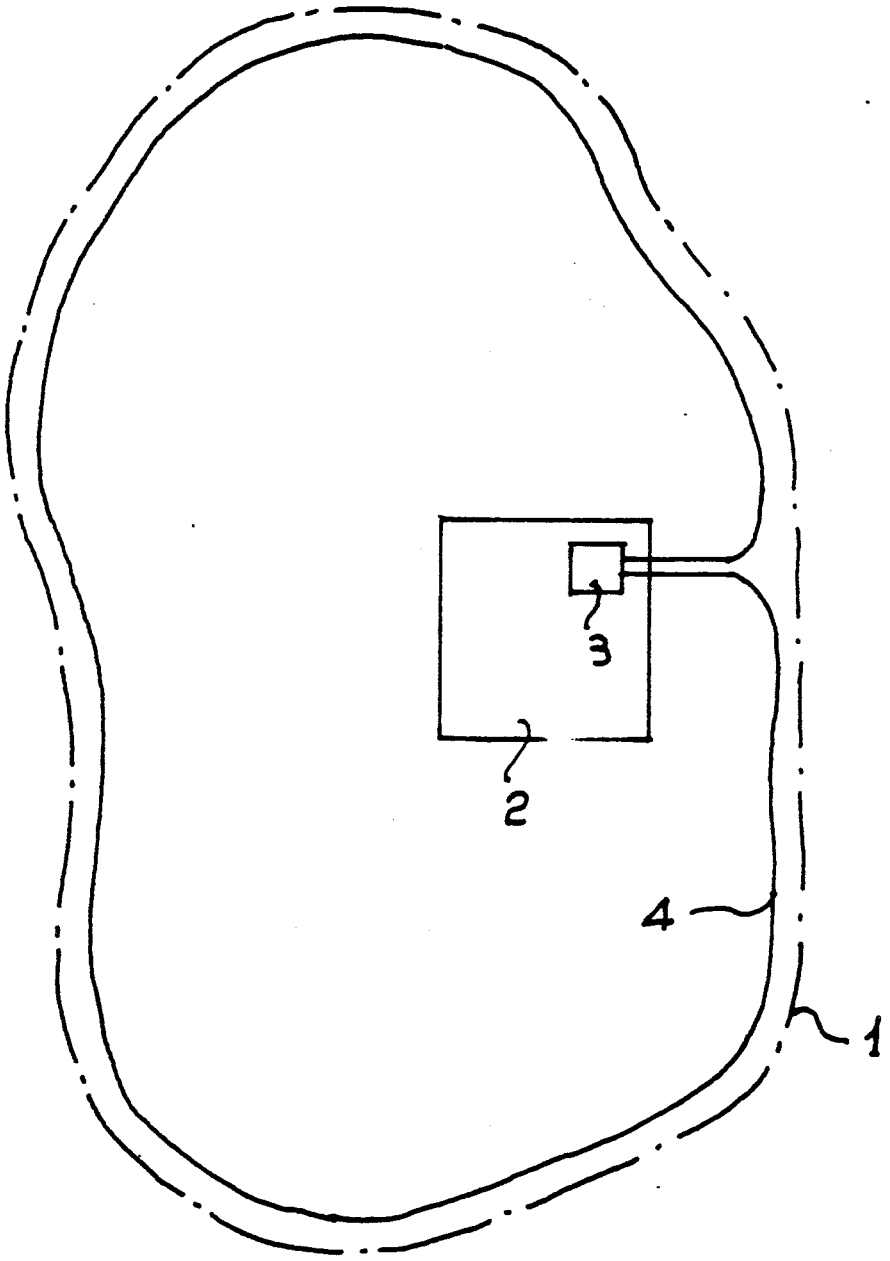
FIG. 1 is a diagrammatic plan view of a first embodiment of the device of the present invention for controlling real property.

With reference to FIG. 1, the area having to be controlled is indicated by the phantom line 1, while reference 2 indicates a property situated within said area, into which can be positioned the electronic circuit 3 integrating the alarm or warning device of the present invention. Said device comprises sensing means consisting of a coaxial cable 4, which is preferably positioned along the periphery of the area 1; the ends of the cable 4—or at least one of them—are connected to the electronic circuit 3.

When the area 1 under control is located in a site where any movements of things and people external to said area are not to be detected by the alarm device (for instance, the movements of vehicles travelling on a road adjacent to the area 1), it will be preferable to position alongside the coaxial cable 4 a continuous baffle slab 5 of material having a greater density than that of the soil, as for example an aligned set of concrete sections like the one illustrated in FIG. 4. Due to the different ratio between the mass of the slab 5 and that of the cable 4, the shock waves transmitted to the soil by the loads moving thereon in a direction F will preferably be absorbed by said slab without affecting—if not to the slightest extent—the cable 4, as opposed to the waves coming from the direction G, that is, from inside the area 1. To improve the screening effect, the slab 5 is preferably in the form of a channel section, and the cable 4 is positioned along the median part of said slab and at a distance therefrom not exceeding 50 cm, and preferably included between 10 and 30 cm.

Figure 2:
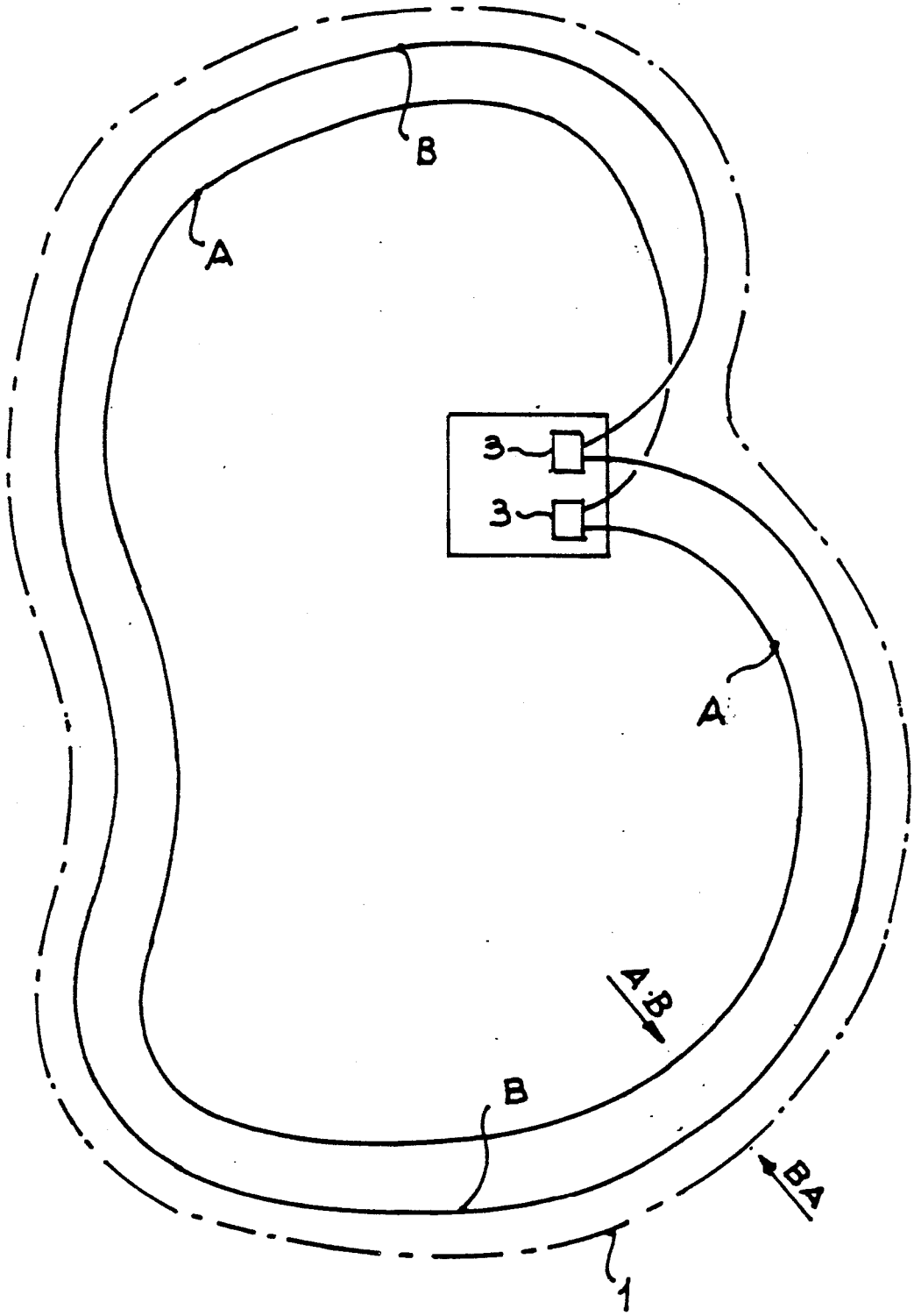
FIG. 2 is a plan view showing another type of installation of a device of the present invention similar to that of FIG. 1.

When wishing to detect only the incoming movements, and not the outgoing ones, or viceversa, it is possible to position two parallel coupled sensors A and B, and detect the differential signal between them. FIGS. 2 and 3 show two examples of installations adopting said principle, for the control of a closed area and, respectively, of a narrow passage. In both cases, the electronic circuits 3 of sensors A and B can be set so as to send warning signals only for movements in a direction AB, rather than for those in a direction BA.

As clearly shown in FIG. 3, the coaxial cable 4 can be positioned straight—with one end free from the electronic circuit 3—or forming a ring—with both ends connected to the electronic circuit 3—so as to form sensing means A and B. The ring arrangement is preferred, as it provides an improved sealing of the cable 4.

The inner structure of a preferred shielded coaxial cable 4, used as sensing means for the alarm or warning device of the present invention, is illustrated in FIG. 5. Said structure comprises an inner conductor 6, a polytetrafluoroethylene insulating sheath 7, a first shielding 8 consisting of a silver copper braid, a second polytetrafluoroethylene insulating sheath 9, a second shielding 10 consisting of a silver copper braid and, finally, an outer polyethylene sheathing of high mechanical and water resistance. The insulating materials used preferably have the following resistivity factors:

polytetrafluoroethylene (teflon): $\rho = 1 \cdot 10^{15}\ \Omega m$ polyethylene: $o = 1 \cdot 10^{12}\ \Omega m$, and the overall capacity of the cable is of about 80 pF/m.

Figure 6:
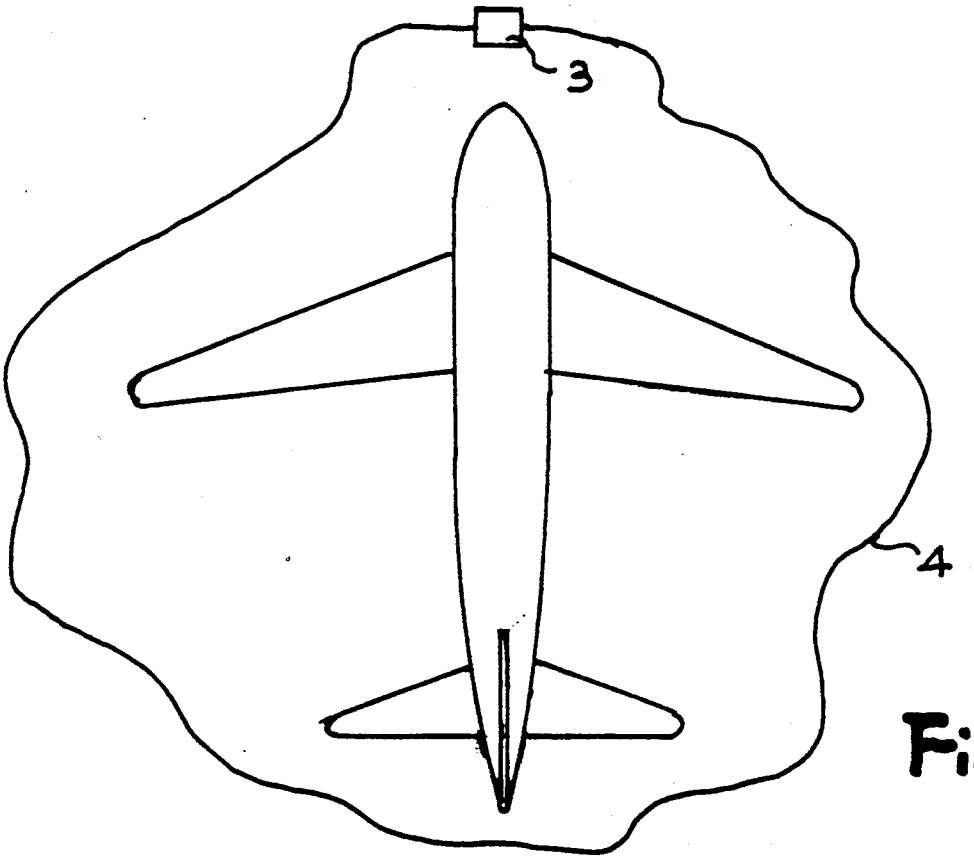
FIG. 6 is a diagrammatic plan view of a second embodiment of the device of the present invention for controlling an aircraft.

FIG. 6 illustrates a second embodiment of the alarm or warning device of the present invention, referred to temporary devices for controlling movables as, for instance, the aircraft shown in the drawing. In such devices—which can have the most varied applications in thief-proof or antisabotage systems—the cable 4 is easily and rapidly positioned on the ground or on other suitable supports close to or in contact with the object being controlled, so as to allow monitoring any movement in the neighbourhood of said object, as well as the displacement or removal of the object itself. According to cases, the circuit 3 can either energize local alarm or warning means, or it can send information to a centralized control station.

Figure 7:
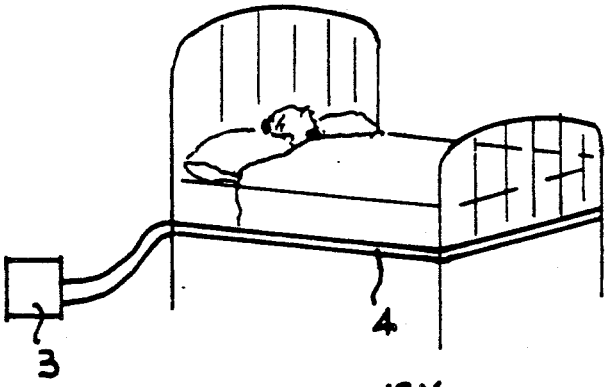
FIG. 7 is a diagrammatic perspective view of a third embodiment of the device of the present invention for the remote control of the life functions of a patient.

FIG. 7 illustrates a third embodiment of the alarm or warning device of the present invention, referred to its use in the medical field, for controlling the life functions of a patient. In this case, the coaxial cable 4 is fixed to the structure of a bed (or of an armchair, an operating-table, or the like) on which the patient is lying, for instance beneath the mattress. In this way, the patient neither in the least feels nor is disturbed by the device of the invention, and the electronic circuit 3 is adapted to remote transmit to suitable warning means (not shown) any data on the life functions of the patient, involving the movement of his inner masses as, for example, breathing or heartbeat. It is thus possible to simultaneously control several patients from a centralized control station, with a prompt intervention upon changing of thier life functions, even when the patient cannot directly call for help.

Figure 8:
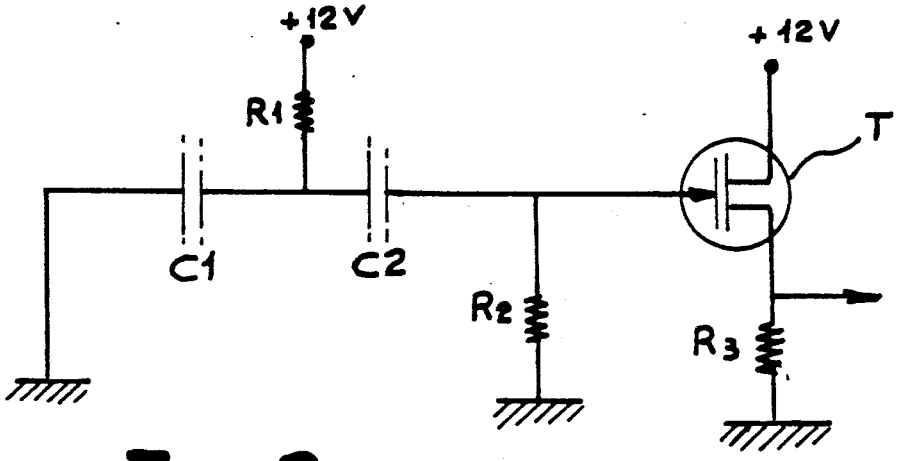
FIG. 8 is a diagram of the electronic circuit detecting the variations in the electric characteristics of said sensing means.

The electronic circuit adapted to detect any variations in the electrical capacity of the sensing means of the alarm or warning device of the present invention can advantageously be of the type described by way of example in FIG. 8. In this diagram, the sensing means of the alarm device are represented by the capacitor C1, and the capacitor C2 has a capacity of 470 pF. The resistors R1 and R2 have a value of 3,300 MΩ, the resistor R3 has a value of 100 kΩ, and the semiconductor device T is of the type known in commerce by the code 2N3819. The whole system is D.C. biased with a 12 V or 24 V voltage, as clearly illustrated in the drawing. After a transient, when the circuit is biased, the power consumption merely compensates the energy losses and is thus very low, taking into account the high values of the resistors R.

With the electronic circuit described heretofore, even very slight variations in the capacity of the capacitor C1, determined by the shock waves of loads moving in proximity to the sensing means, are converted into voltage emissions of the order of magnitude of a few millivolt tens, and are thus reliably detected by suitable alarm or warning instruments.

What is claimed is:

1. Alarm or warning device, comprising sensing means in the form of an electrically charged capacitor and an electronic circuit adapted to detect variations in the electric characteristics of said capacitor and to accordingly energize alarm and warning means, wherein said sensing means consist essentially of at least one shielded coaxial cable having shielding and an inner conductor, one or both ends of which cable are connected to said electronic circuit and wherein a D.C. constant biasing potential difference is applied between the shielding and the inner conductor of said cable.

2. Alarm or warning device as in claim 1, wherein said coaxial cable is positioned under a soil surface, along the outer periphery of a property under control.

3. Alarm or warning device as in claim 1, wherein said coaxial cable is positioned on a soil surface or onto a suitable support in proximity of or in contact with movable objects under control.

4. Alarm or warning device as in claim 1, used in the medical field for controlling the life functions of a patient, wherein said coaxial cable is fixed to the bed or to any other supports holding the body of the patient.

5. Alarm or warning device as in claim 1, wherein the electrical capacity of said coaxial cable is about 80 pF/m.

6. Alarm or warning device as in claim 1, wherein said D.C. constant biasing potential difference of the coaxial cable is equal to 12 V.

7. Alarm or warning device, comprising sensing means in the form of an electrically charged capacitor and an electronic circuit adapted to detect variations in the electric characteristics of said capacitor and to accordingly energize alarm and warning means, wherein said sensing means consist essentially of at least one shielded coaxial cable having shielding and an inner conductor, one or both ends of which cable are connected to said electronic circuit and wherein a D.C. constant biasing potential difference is applied between the shielding and the inner conductor of said cable; and wherein said coaxial cable comprises, starting from its center: an electric conductor, a first insulating sheath, a first metal shielding, a second insulating sheath, a second metal shielding, and a third outer insulating sheath.

8. Alarm or warning device as in claim 7, wherein said first and second inner sheaths are of polytetrafluoroethylene and have a resistivity factor of $1.10^{15}$ Ωm; said outer sheath is of polyethylene and has a resistivity factor of $1.10^{12}$ Ωm; and said first and second metal shieldings are of silver copper braid.

9. Alarm or warning device, comprising sensing means in the form of an electrically charged capacitor and an electronic circuit adapted to detect variations in the electric characteristics of said capacitor and to accordingly energize alarm and warning means, wherein said sensing means consist essentially of at least one shielded coaxial cable having shielding and an inner conductor, one or both ends of which cable are connected to said electronic circuit and wherein a D.C. constant biasing potential difference is applied between the shielding and the inner conductor of said cable; wherein said coaxial cable is positioned under a soil surface, along the outer periphery of a property under control, and wherein, parallel to said cable and on the side external to that under control there is positioned a substantially vertical continuous baffle slab of material having a greater density than that of the surrounding soil.

10. Alarm or warning device as in claim 9, wherein the distance between said coaxial cable and said slab is between 10 and 30 cm, and the cable is positioned along the median part of said slab.

11. Alarm or warning device as in claim 9, wherein said baffle slab consists of an aligned set of concrete elements, substantially in the form of channel sections.

12. Alarm or warning device, comprising sensing means in the form of an electrically charged capacitor and an electronic circuit adapted to detect variations in the electric characteristics of said capacitor and to accordingly energize alarm and warning means, wherein said sensing means consist essentially of at least one shielded coaxial cable having shielding and an inner conductor, one or both ends of which cable are connected to said electronic circuit and wherein a D.C. constant biasing potential difference is applied between the shielding and the inner conductor of said cable; and wherein the shielding of the coaxial cable is grounded, the electric conductor of the coaxial cable is connected to the base of a semiconductor device by way of a capacitor and to the positive pole of the direct current supply by way of a first resistor, the base of the semiconductor device being moreover grounded by way of a second resistor.

13. Alarm or warning device as in claim 12, wherein said first and second resistors have a value of 3,300 MΩ.

* * * * *